US011965394B1

(12) United States Patent
Turner et al.

(10) Patent No.: US 11,965,394 B1
(45) Date of Patent: Apr. 23, 2024

(54) SUBSEA TEST TREE FAST BALL ACTUATION WITH LOW PRESSURE PUMP THROUGH CAPABILITY

(71) Applicant: Halliburton Energy Services, Inc., Houston, TX (US)

(72) Inventors: Ryan Anthony Turner, Carrollton, TX (US); Kenneth L. Schwendemann, Carrollton, TX (US); Darrin N. Towers, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/238,105

(22) Filed: Aug. 25, 2023

(51) Int. Cl.

| | |
|---|---|
| ***E21B 29/00*** | (2006.01) |
| ***E21B 34/04*** | (2006.01) |
| ***E21B 34/16*** | (2006.01) |
| ***F16K 31/122*** | (2006.01) |

(52) U.S. Cl.
CPC ..... *E21B 34/045* (2013.01); *E21B 2200/04* (2020.05)

(58) Field of Classification Search
None
See application file for complete search history.

(56) References Cited

U.S. PATENT DOCUMENTS 4,494,609 A * 1/1985 Schwendemann ..... E21B 34/10 166/336
4,522,307 A * 6/1985 Steiner ..... B65D 50/06 215/256
4,522,370 A * 6/1985 Noack ..... E21B 34/045 166/324
5,044,432 A * 9/1991 Cunningham ..... E21B 33/04 285/123.3
5,284,209 A * 2/1994 Godfrey ..... E21B 29/08 166/380

(Continued)

FOREIGN PATENT DOCUMENTS

WO 2011049970 A2 4/2011

OTHER PUBLICATIONS

Chul-Kyu Kim et al., Performance Analysis of a Ball Valve Used for Gas Pipelines by Introducing Nondimensional Parameters, Advances in Mechanical Engineering, 2019, pp. 1-10, vol. 11.

(Continued)

*Primary Examiner* — Matthew Troutman
*Assistant Examiner* — Douglas S Wood
(74) *Attorney, Agent, or Firm* — Conley Rose, P.C.; Rodney B. Carroll

(57) ABSTRACT

A method of actuating a subsea tree comprising opening a valve assembly by transferring a first volume of fluid into a first chamber and closing the valve assembly from the open position to a shear position via a gas charged valve actuator in response to the transfer of fluid out of the first chamber. Shearing a workstring positioned within an axial bore of the valve assembly with the valve via the gas charged valve actuator. Closing the valve from the shear position to a closed position with one or more gas charged push rods to isolate the wellbore above from the wellbore below the closed valve. The shearing force generated from the gas charged valve actuator is greater than the closing force of the one or more push rods.

21 Claims, 7 Drawing Sheets

(56) References Cited

U.S. PATENT DOCUMENTS

| | | | | |
|---|---|---|---|---|
| 5,551,665 | A * | 9/1996 | Noack | E21B 29/08 251/315.1 |
| 5,884,707 | A * | 3/1999 | Garcia-Soule | E21B 23/006 166/356 |
| 8,398,053 | B2 | 3/2013 | Ezekiel | |
| 8,602,108 | B2 | 12/2013 | Mathis | |
| 9,322,242 | B2 | 4/2016 | Buchan et al. | |
| 9,410,391 | B2 * | 8/2016 | Guven | E21B 29/04 |
| 9,957,772 | B2 * | 5/2018 | Tennant | E21B 29/08 |
| 11,655,902 | B2 | 5/2023 | Meijer et al. | |
| 11,668,150 | B2 | 6/2023 | Szpunar et al. | |
| 2003/0150620 | A1 * | 8/2003 | DeBerry | E21B 33/043 166/88.4 |
| 2005/0217845 | A1 | 10/2005 | McGuire | |
| 2014/0175317 | A1 * | 6/2014 | Tennant | E21B 33/043 251/315.01 |
| 2020/0080397 | A1 | 3/2020 | Walker | |

OTHER PUBLICATIONS

J . Koto, Application of Subsea Tree Deep Water Second Edition, Oct. 2017. pp. 1-70. Ocean & Aerospace Research Institute Indonesia.

* cited by examiner

SUBSEA TEST TREE FAST BALL ACTUATION WITH LOW PRESSURE PUMP THROUGH CAPABILITY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are commonly obtained from subterranean formations that may be located onshore or offshore. The construction of a hydrocarbon producing well can comprise a series of construction steps designed to extract hydrocarbons efficiently and safely. The process typically begins with the selection of a drilling location based on geological studies and seismic data analysis. Once the drilling site is identified, a drilling rig is mobilized to the location.

The drilling operation commences with the drilling of the wellbore, which involves the use of a drill bit attached to the bottom of a drill string. The drill string is typically rotated, and a drilling mud, e.g., a combination of water, weighting materials, and additives, is circulated down the drill string and back up the annular space between the drill string and the wellbore walls. This process serves multiple purposes, including cooling and lubricating the drill bit, stabilizing the wellbore, and carrying rock cuttings to the surface.

Once the desired depth is reached, the drilling phase of the wellbore construction process is completed, and the wellbore can be isolated from wellbore fluids. A primary cementing operation comprises the installation of casing, also referred to as a casing string, which consists of metal tubulars, e.g., steel pipes, coupled together, placed into the wellbore, and cemented in place. The cementing operation can place a cement slurry tailored for the wellbore environment within an annular space between the casing and the wellbore. The cemented casing string provides structural integrity, prevents well collapse, and isolates different geological formations to ensure the flow of hydrocarbons from the target zone. The cementing operation can comprise multiple strings of casing extending from a previous casing string. For example, a bottom of a first casing string, e.g., a float shoe, can be drilled out to extend the wellbore past the first casing string. A second casing string can be installed through the first casing string by a second cementing operation. Likewise additional casing strings, e.g., a third and fourth casing strings, can be installed through each subsequent casing string.

During a completion stage, various completion equipment can be installed into the wellbore and the casing string can be opened to couple the wellbore to a target production zone, e.g., hydrocarbon bearing reservoir. The completion stage may include wellbore servicing operation, a cleaning operation, an equipment installation, a delivery of fluid treatments, a valve actuation, a wellbore perforating operation, a well stimulation, or other completion operations utilizing coil tubing, electric line, wireline, or combinations thereof. For example, a wellbore cleaning operation can utilize coil tubing with various downhole service tools to clean the inner surface of the casing, remove debris from the wellbore, and/or replace the drilling fluids, e.g., drilling mud, present in the wellbore with a completion fluid such as brine. In another scenario, a completion operation may position a completion valve within the wellbore completion in an open or closed position by conveying a positioning tool to the completion valve at a target depth in the wellbore.

A subsea test tree may be placed within the blowout preventer stack prior to a wellbore servicing operation. The subsea test tree generally includes a valve portion which has one or more safety valves that can automatically shut-in the well in case of emergency or unplanned events in the wellbore environment. In the case of emergency, the subsea test tree can be configured to cut or sever the workstring, e.g., wireline passing through the valve. In some scenarios, an emergency closure of the blow out preventer stack may cut the control lines to the subsea test tree and thus normal operational control of the subsea test tree is lost. The pumping and/or placement of heavy weight fluids in the wellbore is desirable to prevent the ingress of uncontrolled formation fluids into the wellbore. A method of operating the subsea test tree for placement of heavy weight fluids after the loss of normal operational control is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
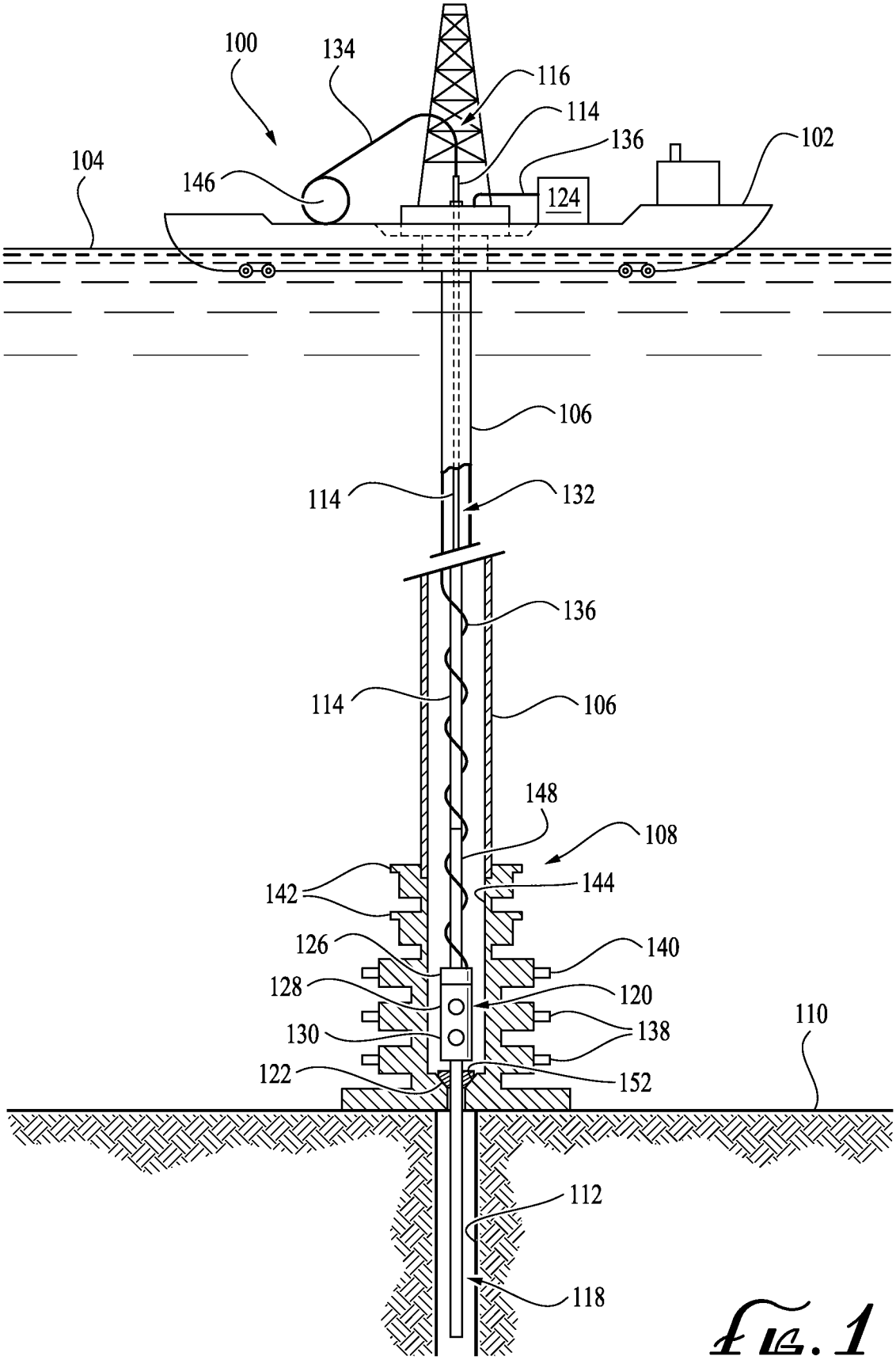
FIG. 1 is a diagram illustrating an exemplary environment for a subsea tree according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

During the completion operations, an upper and/or lower completion may be installed into the wellbore. A lower completion may be utilized to isolate the formation and/or provide a filter media for unwanted erosive particles. For example, a packer and at least one sand screen may be used to isolate a production zone when erosive sand particles are present or predicted within the fluids produced from the formation, e.g., production fluids. An upper completion may be utilized to isolate another oil bearing formation and/or provide one or more production valves to isolate the production tree from the wellbore environment.

In some scenarios, a completion operation can be performed via a workstring to open or close one or more valves, perforate the casing string in one or more locations, clean-out debris at a target depth, swap out fluids, or a combination thereof. A subsea safety tree can be placed within a blow-out preventer stack to provide a pathway for a service tool string to pass through the blow-out preventer and/or the production tree and/or subsea wellhead and into the wellbore. The subsea safety tree can comprise one or more actionable valves with an open position and a closed position. In an emergency type scenario, the subsea safety tree can be closed when the workstring is within the subsea safety tree and the service tool string is somewhere below the subsea safety tree, e.g., the lower completion. The closure of the one or more actionable valves can cut the workstring as the valve closes to a sealing position. The sealing position of the one or more actionable valves can isolate the riser environment above the subsea tree from the wellbore environment below the subsea safety tree. In some scenarios, the closure of one of the shears of the blow-out preventer stack can sever or cut a control line used to actuate, e.g., open and close, the subsea safety tree. It is desirable to open the one or more valves within the subsea tree to pump a heavy weight fluid into the wellbore below the subsea safety tree to kill the well, e.g., prevent ingress of formation fluids into the wellbore. However, the subsea safety tree may not be reopened via control lines after the lines have been cut. Typically, the valve mechanism requires an elevated pressure within the tubing and/or riser to actuate the one or more valves to an open position or partially open position. In some scenarios, this elevated pressure may be near the operational capacity of the tubing, riser, subsea safety valve or combinations thereof, thus it is undesirable to apply this level of elevated pressure. A valve mechanism that can actuate at a lower pressure after emergency closure is desirable.

A method of selectively closing one or more valves while utilizing a small piston area to seal each valve closed is described. In some embodiments, the method of selectively closing one or more valve can utilize a first piston area to close the valve and a second piston area to seal the valve. The first piston area can be a large piston area configured to transfer a large force to close the valve and, in some scenarios, shear a workstring within the valve. The second piston area can be small piston area configured to transfer a small force to seal the valve in the closed position. The small piston area can reopen the valve assembly when fluid pressure is applied from above the closed mechanism. The valve assembly can reopen or partially reopen at a lower pressure, for example, a pressure significantly below the operational pressure of the tubing, riser, and/or subsea safety valve. By application of this method, the subsea test tree can be reopened at a lower pressure after emergency closure leading to reduced stress level above the closed valve assembly, a more robust opening mechanism, and a safer operational method.

Turning now to FIG. 1, an illustration of a subsea well testing system 100 can be described. In some embodiments, a subsea well testing system 100 includes a floating platform location 102, e.g., a drillship, which is dynamically positioned on a water surface 104 with a riser 106 extending from a service platform of the floating platform location 102 to a blowout preventer ("BOP") stack 108 on seafloor 110. A wellbore 112 can be drilled from the seafloor 110 to a target subterranean formation. In a scenario, a casing string can extend downward from a wellhead located on the seafloor 110 and be cemented into the wellbore 112. A production tree may be coupled between the BOP stack 108 and the wellhead. In some embodiments, a tubing string 114 extends from platform 102, through blowout preventer stack 108, and into wellbore 112. The tubing string 114 can be referred to as a header extension and may provide a pathway through the BOP stack 108 and production tree for a service tool string conveyed into the wellbore 112 on a workstring 134.

Subsea well testing system 100 includes a subsea test tree 120 (e.g., subsea test tree, "SSTT") positioned or landed within the BOP stack 108. The subsea test tree 120, also referred to as a subsea tree, can be fluidically coupled to a topside control station 124 by one or more fluid conduits 136. A fluted hanger 122 coupled to a lower portion 118 of the tubing string 114 can be landed or positioned within a receiving shoulder 152 within the BOP stack 108. The fluted hanger 122 can align the subsea tree 120 with one or more features, e.g., shear rams, within the BOP stack 108. The subsea tree 120 can comprise a latch 126, an upper valve assembly 128, and a lower valve assembly 130. A lower portion 118 of tubing string 114 can extend from the subsea tree 120 into the wellbore 112. The upper valve assembly 128 may include a ball valve that acts as a master control valve during testing of wellbore 112. The lower valve assembly 130 can comprise one or more flapper valves and/or ball valves that may be operated in series. The one or more fluid conduits 136 may fluidically couple the latch 126, upper valve assembly 128, the lower valve assembly 130, or combinations thereof to the control station 124. The latch 126 allows an upper portion 132 of tubing string 114 to be disconnected from subsea tree 120 if desired. It should be clear that the embodiments are not limited to the particular embodiment of subsea tree 120 shown, but any other valve system that controls flow of formation fluids through tubing string 114 may also be used.

The one or more fluid conduits 136 can include electrical conductors and/or optical conductors coupled to additional downhole tools. For example, upper portion 132 and/or lower portion 118 may include a sensor module and/or fluid control valve electrically and/or optically coupled to the one or more conduits 136. The one or more conduits 136 may be operationally connected to surface sources of power (e.g., electrical, hydraulic) in addition to electronics, communications, and power that may be provided via topside control station 124.

Subsea tree 120 is shown landed in BOP stack 108 on tubing string 114. The upper valve 128 and lower valve 130 within the subsea tree 120 can be in the open position to allow passage of one or more service tools coupled to the workstring 134. The workstring 134 can be conveyed into the tubing string 114 via a passage 116 and/or wellbore 112 by a wellbore servicing unit 146 for conveying a workstring, for example, a coil tubing unit, a wireline unit, a logging unit, or any other suitable servicing unit. In some scenarios, the upper valve 128 and lower valve 130 can be in the open position for production flow, e.g., to allow fluid flow from lower portion 118 of tubing string 114 to upper portion 132 of tubing string 114, and/or for injection flow, e.g., to allow fluid flow from upper portion 132 to the lower portion 118 of tubing string 114. In the event of an emergency, upper valve 128 and lower valve 130 can be automatically closed to prevent production fluid flow or injection fluid flow, e.g., fluid flow from flowing from lower portion 118 to upper portion 132 of tubing string 114. After the valves 128 and 130 are closed, e.g., in the fully closed position, the upper portion 132 of tubing string 114 may be disconnected from subsea tree 120 and retrieved to the platform 102 or raised to a level which will permit vessel 102 to be moved in some instances. Although vessel 102 is illustrated as a ship, vessel 102 may include any platform suitable for wellbore drilling, production, or injection operations, e.g., a barge rig, a submersible rig, a jack-up rig, a platform rig, a floating rig, a semi-submersible platform, a drill ship, or any other type of wellbore servicing rig. Although the subsea tree 120 is described as operating in a subsea environment, the subsea tree 120 can operate in any environment including a wellhead, a production tree, a BOP, or any combination thereof located on land, on a platform, in shallow water (less than 10,000 feet of water), in deep water (greater than 10,000 feet of water), or any combination thereof. In some embodiments, the subsea tree 100 can be used with or without a BOP stack. For example, the wellbore can be coupled to a wellhead that is coupled to a pressure isolation device, e.g., production tree, with or without a BOP stack. In a scenario, the subsea tree 100 can be coupled to the wellhead or the production tree with a flowline, e.g., riser if subsea or extension if on land, with a workover unit, e.g., coil tubing or wireline unit, connected to the flowline. In some embodiments, the subsea tree 100 can be located below the wellhead, e.g., within the wellbore. In a scenario, the subsea tree 100 can be located above and/or below the wellhead and fluidically coupled to the pressure isolation device, e.g., production tree.

Although the exemplary blowout preventer stack 108 is illustrated with two or more pipe ram seals 138 and shear ram seal 140, it is understood that other combinations of ram seals may be used. A lower marine riser package may be mounted between blowout preventer stack 108 and riser 106 and may include annular preventer seals 142. The lower marine riser package also typically includes control modules for operating annular preventer seals 142, ram seals 138 and 140 in blowout preventer stack 108, and other controls as needed. Ram seals 138 and 140 and annular preventer seals 142 define a passage 144 for receiving tubing string 114 and/or subsea tree 120. Subsea tree 120 is arranged within blowout preventer stack 108 with the slick joint 148 extending from subsea tree 120 into annular preventer seals 142.

The subsea tree 120 can be operable by the control station 124 with hydraulic pressure via the conduits 136. For example, the subsea tree 120 may be actuated, e.g., positioned in the closed position, by hydraulic pressure via the control station 124. In some embodiments, the subsea tree 120 may be actuated by the loss of pressure within one or more conduits 136. In some embodiments, the subsea tree 120 may be actuated, e.g., positioned in the closed position, by one or more shear ram seals 140 cutting or breaking the conduits 136.

Figures 2A, 2B:
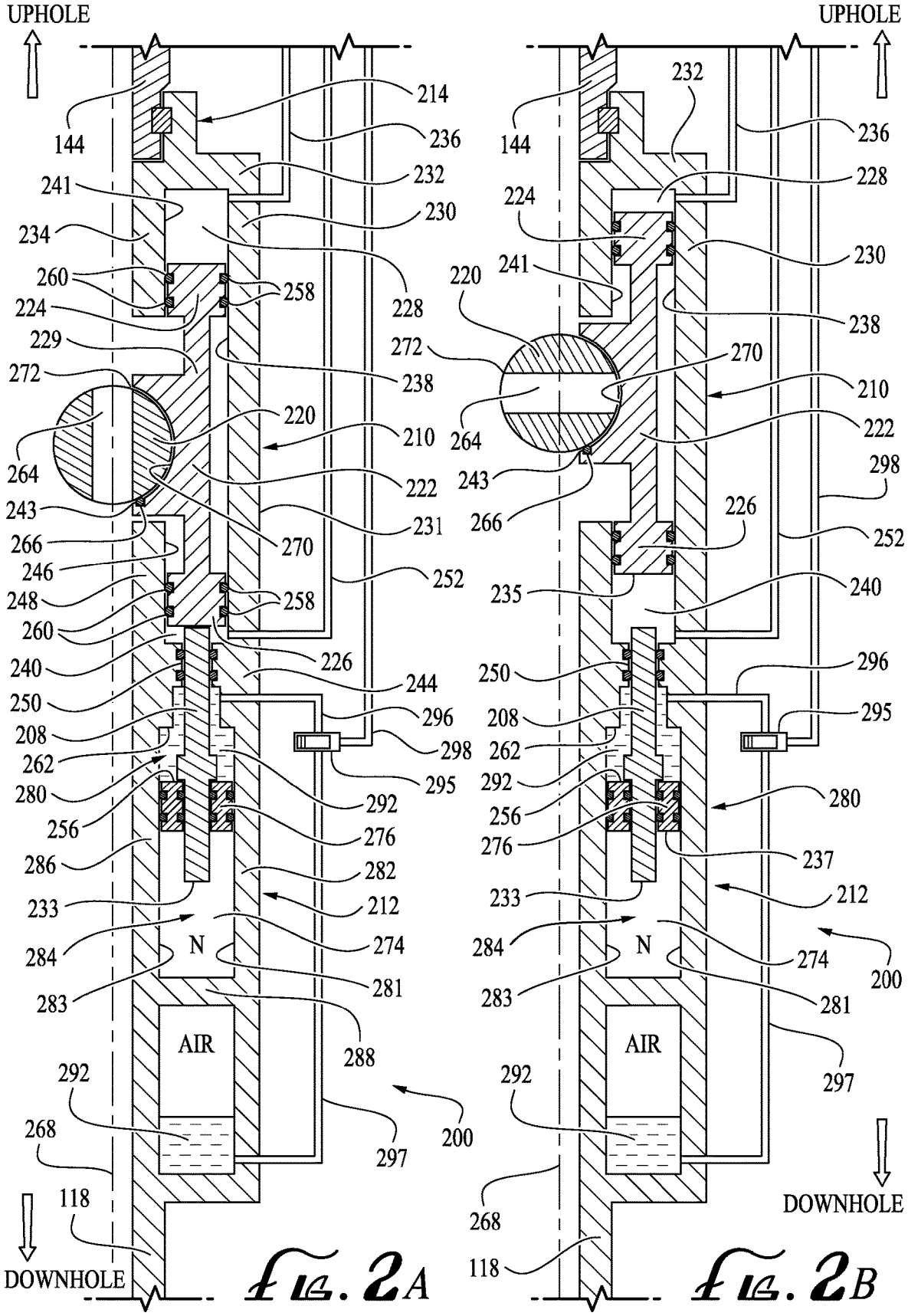
FIG. 2A is a partial cross-sectional view of a subsea tree assembly in an open position according to an embodiment of the disclosure.
FIG. 2B is a partial cross-sectional view of a subsea tree assembly in a closed position according to an embodiment of the disclosure.

Turning now to FIG. 2A, a partial cross-sectional view of a subsea tree can be described. In some embodiments, the subsea tree 200 comprises a ball valve assembly 210 and a fail-safe actuator 212. The subsea tree 200 can be coupled to the slick joint 148 on an uphole end and to the lower portion 118 on the downhole end. In some embodiments, a releasable latch 214 can couple the slick joint 148 to the subsea tree 200.

The ball valve assembly 210 comprises a ball 220, a ball support 222, a first piston 224, and a second piston 226. The ball 220 can be rotationally coupled to the ball support 222 by one or more control arms and/or rotating members. The ball support 222 can be coupled to the first piston 224 and second piston 226 by a connecting member 229. The first piston 224 can be sealingly engaged with a first chamber 228 formed by an inner surface 238 of a valve housing 230, a first end 232, and an outer surface 241 of an upper mandrel 234. The valve housing 230 can be generally cylinder shape with an outer surface 231 and an inner surface 238. The first piston 224 can be sealingly engaged to the valve housing 230 by one or more outer seals 258 and to the upper mandrel 234 by one or more inner seals 260. A first conduit 236 can fluidically couple the first chamber 228 to the control station 124 on the platform 102.

The second piston 226 can be sealingly engaged with a second chamber 240 formed by the inner surface 238 of the valve housing 230, a ported sub 244, and an outer surface 246 of a lower mandrel 248. The ported coupling can be generally cylinder shape with an outer surface and one or more push rods 208 in corresponding push rod ports 250. A second conduit 252 can fluidically couple the second chamber 240 to the control station 124 on the platform 102.

The ball 220 can be actuated or positioned by the control station 124 via the first conduit 236 and the second conduit 252. In some embodiments, pressure applied to the first chamber 228 via the first conduit 236 while fluid is released from the second chamber 240 can move the first piston 224 and second piston 226 downwards or towards the ported sub 244. The movement of the piston 224, 226 can rotate the ball 220 into an open position, e.g., a passage 264 can align with the longitudinal axis 268 of the subsea tree 200.

Turning now to FIG. 2B, the ball 220 can be actuated to the closed position by pressure applied to the second conduit 252. In some embodiments, pressure applied to the second chamber 240 while fluid is released from the first chamber 228 can move the second piston 226 upwards or towards the first end 232. The movement of the piston 224, 226 can rotate the ball 220 into a closed position, e.g., the passage 264 can be positioned perpendicular or out of alignment with the longitudinal axis 268 of the subsea tree 200. One or more ball seals 266 located in corresponding circumferential grooves in the spherical surface 270 of the ball support 222 can sealingly engage the ball 220 to isolate the wellbore environment below the subsea tree 200 from the wellbore environment above the subsea tree 200. Although the ball 220 is described as moving to the closed position, it is understood that the ball 220 can be actuated from the closed position to the open position or the open position to the closed position any number of times.

In some embodiments, the rotation of the ball 220 from the open position (FIG. 2A) to the closed position (FIG. 2B) can shear or cut a workstring 134 passing through the passage 264 of the ball 220. For example, a pressure applied to the second chamber 240 can rotate the ball 220 until a ball edge 272 contacts and shears through the workstring 134. The pressure needed to shear the workstring 134 can depend on the type of workstring 134. For example, the pressure applied to shear coil tubing can be greater than the pressure applied to shear braided line which can be greater than the pressure applied to shear wireline. The shearing motion will be disclosed further herein.

The fail-safe actuator 212, also referred to as a valve actuator, can close the ball 220 on the subsea tree 200 when fluid pressure within one or more conduits is lost. With reference to FIGS. 2A and 2B, the fail-safe actuator 212 comprises an activation chamber 274, an activation piston 276, and a fluid reservoir 292. The activation chamber 274 can be formed by the ported sub 244, an inner surface 281 of a release housing 282, an outer surface 283 of a release mandrel 286, and an end surface of a cylinder plug 288. The activation piston 276 can be sealingly engaged with the inner surface 281 of the release housing 282 and outer surface 283 of the release mandrel 286 by one or more seals. The outer surface 204 of one or more push rods 208 can be sealingly engaged with seals 206 installed in circumferential grooves within corresponding piston ports 202 within the activation piston 276. The one or more push rods 208 can include a protrusion 290 with a first face 239 and a second face 245 and the second face 245 may abut the activation piston 276.

A volume of gas can be utilized to bias the activation piston 276 to close the ball 220. The activation chamber 274 can be separated into a first activation chamber 280 and a second activation chamber 284 by the activation piston 276. The first activation chamber 280 can be filled with a fluid, e.g., hydraulic fluid. The second activation chamber 284 can be pressurized with a gas, e.g., nitrogen gas, to a predetermined pressure level to act as a spring to bias the activation piston 276 to move towards the ported sub 244. In a context, the term nitrogen charge can refer to the volume and pressure of nitrogen gas in the second activation chamber 284. In a context, the term nitrogen piston can be defined as the nitrogen charge biasing a combined cross-sectional area of the end face 237 of the activation piston 276 and the end face 233 of the push rod 208. For example, the nitrogen charge can bias the activation piston 276 can be in direct contact with an end face of the protrusion 290 of the push rod 208. In some embodiments, the push rod 208 can be releasably coupled to the activation piston 276, e.g., via a shear device. In a context, the term seal piston can be defined as the nitrogen charge biasing the cross-sectional area of end face 233 of the push rod 208. The volume of hydraulic fluid within the first activation chamber 280 can be trapped and incompressible or relatively incompressible to resist the movement of the activation piston 276 biased by the nitrogen charge, e.g., second activation chamber 284.

The volume of hydraulic fluid within the first activation chamber 280 can be fluidically coupled with a fluid reservoir 292. The fluid reservoir 292 may be separated from the activation chamber 274 by the cylinder plug 288 and can be formed by the cylinder plug 288, an inner surface 281 of a release housing 282, an outer surface 283 of a release mandrel 286, and an end surface of a end sub 294. The volume of the fluid reservoir 292 can be partially filled with air and partially filled with hydraulic fluid. The first activation chamber 280 can be fluidically coupled to a pilot valve 295 by a first conduit 296. A second conduit 297 can fluidically couple the fluid reservoir 292 to the pilot valve 295. In some embodiments, the fluid reservoir 292 can be fluidically coupled to the first activation chamber 280 in response to the pilot valve 295 being configured in the open position. In another scenario, the pilot valve 295 can isolate the fluid reservoir 292 from the first chamber 280 when the pilot valve 295 is configured in the closed position.

A conduit coupled to the pilot valve 295 from surface can activate the fail-safe actuator 212. In some embodiments, a communication conduit 298 can fluidically couple the pilot valve to the control station 124 located on the platform 102. In some embodiments, an applied pressure value from the control station 124 via the communication conduit 298 to the pilot valve 295 can configure the pilot valve 295 in the closed position, e.g., isolating the first chamber 280. The pilot valve 295 can be configured in the open position i) by the control station 124 removing (or reducing) the applied pressure or ii) by cutting the communication conduit 298. For example, the shear ram seals 140 can be activated to cut or shear through the slick joint 148 and the conduit 298 in the case of an emergency, e.g., uncontrolled ingress of formation fluids. The removal or loss of applied pressure to the communication conduit 298 can configure the pilot valve 295 in the open position and fluidically couple the first activation chamber 280 with the fluid reservoir 292.

Figure 2C:
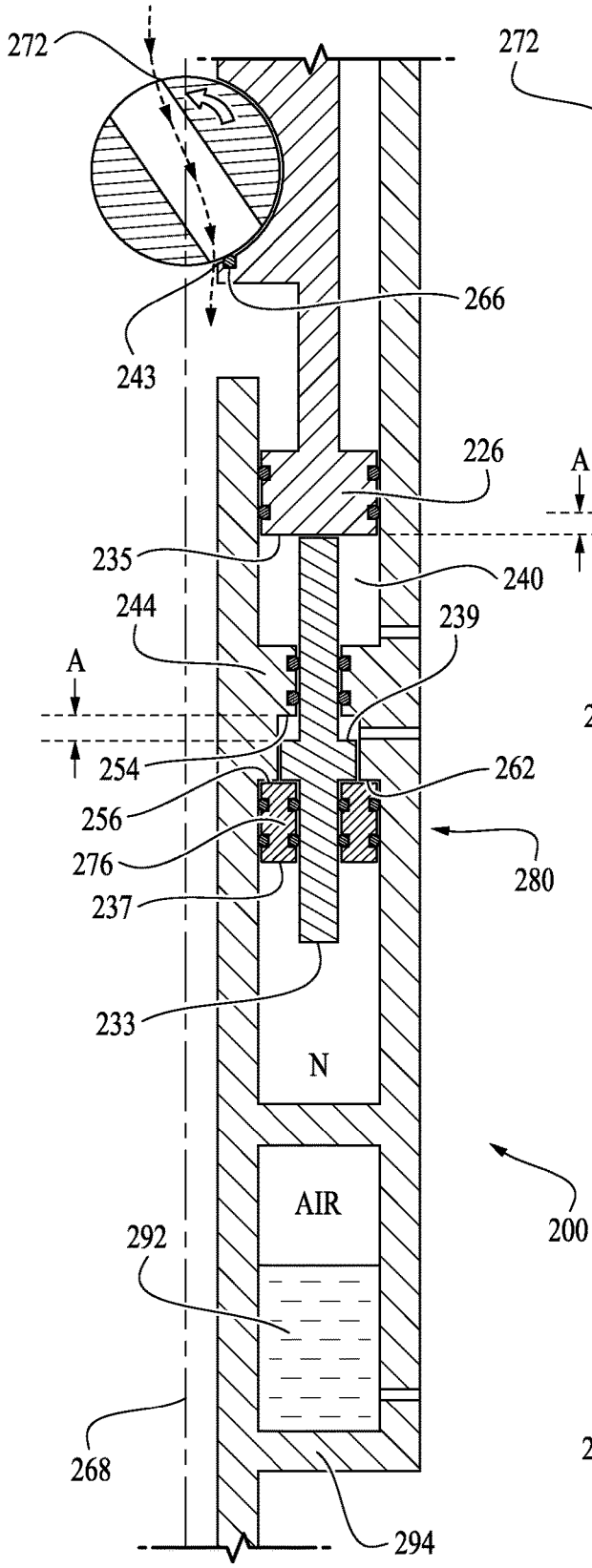
FIG. 2C is a partial cross-sectional view of a subsea tree assembly in a shear position according to an embodiment of the disclosure.
Figure 2D:
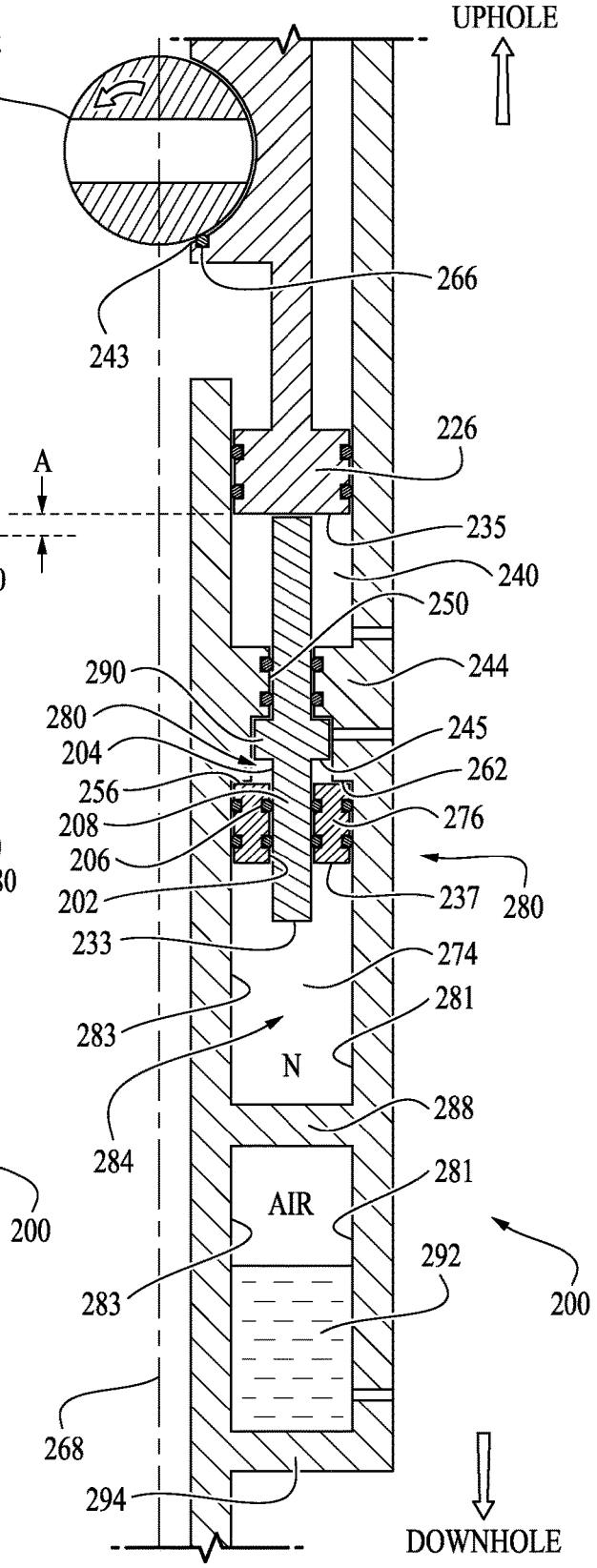
FIG. 2D is a partial cross-sectional view of a subsea tree assembly in a closed position according to an embodiment of the disclosure.

The release of the fluid from the first chamber 280 can release the activation piston 276 and close the ball valve assembly 210. Turning now to FIGS. 2C and 2D, a detailed and enlarged view of FIG. 2A-B can be described. Although not all parts and surfaces are labeled, it is understood that the same parts and surfaces of FIG. 2A-B are shown in FIG. 2C-D. The nitrogen charge, e.g., pressure within the activation chamber 274, can bias the activation piston 276 upwards, e.g., towards the ported sub 244. In response to the pilot valve 295 opening and the fluid within the first chamber 280 transferring to the fluid reservoir 292, the nitrogen piston can move towards the second piston 226. For example, the activation piston 276 can contact the protrusion 290 on the push rod 208 and together, e.g., the nitrogen piston, can move or translate parallel to the longitudinal axis 268 as the hydraulic fluid transfers out of the first chamber 280, through the pilot valve 295 and into the fluid reservoir 292. The push rod 208 can contact the end face 235 of the second piston 226 and urge the second piston 226 to axially translate from a first position, as shown in FIG. 2A, with the ball 220 in the open position to a second position, as shown in FIG. 2C, with the ball 220 in a shear position. The axial translation of the piston 226 can rotate the ball 220 via one or more control arms. The ball edge 272 of the passage 264 of the ball 220 can be i) aligned or ii) overlapped with a cutting edge 243 of the ball support 222 in the second position, e.g., the shear position, to shear or cut through a workstring 134 with the passage 264. In some embodiments, the ball 220 may not be sealingly engaged with the ball support 222 in the second position. In other words, the ball 220 may not hold pressure and allow a fluid flowrate from a first fluid environment above the ball valve 210 to a second fluid environment below the ball valve 210.

In some embodiments, the cutting or shearing force of the ball edge 272 against the cutting edge 243 of the ball support 222 can be a function of the nitrogen piston, e.g., pressure and cross-sectional area. The force transferred from the one or more rods 208 to the second piston 226 can be determined by the pressure within the activation chamber 274 acting on the combined cross-sectional area of the end face 237 of the activation piston 276 and the end face 233 of the rod 208. The pressure within the activation chamber 274 can be a predetermined value based on the force required to shear i) wireline, ii) braided cable, iii) electric line, iv) coil tubing, v) or combinations thereof.

As shown in FIG. 2C, the ball 220 can be configured in a second position, e.g., a shear position, in response to the activation piston 276 traveling axially to contact a limit shoulder 262. The limit shoulder 262 can stop the activation piston 276 and thus, the force of the nitrogen piston, after the ball 220 has rotated to the second position. For example, a front face 256 of the activation piston 276 can contact the limit shoulder 262 as the ball 220 rotates to the second position. The first face 239 of the protrusion 290 on the push rod 208 can be an axial distance "A" from an end face 254 of the ported sub 244.

A smaller force can be utilized to close the ball 220 after the shearing action of the second position. Turning now to FIG. 2D, the second piston 226 can be moved to a third position from the second position by the one or more push rods 208 traveling an axial distance "A." Likewise, the ball 220 can be rotated from a second position, e.g., the shear position, to a third position, e.g., a closed position, by the second piston 226 moving to the third position, e.g., traveling the axial distance "A." The support can be in sealing engagement with the ball 220 in response to the passage 264 of the ball 220 rotating past a seal 266 on the support 222. In a context, the third position can be referred to as a sealing position. In other words, the ball 220 may hold pressure in the sealing position and prevent fluid from transferring from a first wellbore environment above the ball valve 210 to a second wellbore environment below the ball valve 210. In a context, the force utilized to close the ball is a fraction of the force utilized in the shearing action. For example, the cross-sectional area and/or the force to close the ball 220 can be 5%, 6%, 7%, 8%, 9%, 10%, 11%, 12%, 13%, 14%, 15% or any fraction from 5% to 15% of the cross-sectional area and/or force to position the ball 200 into the shear position.

The closure of the ball 220 to the sealing position by the fail-safe actuator 212 can isolate the wellbore environment within the wellbore 112 below the subsea tree 120. A well operator may desire to pump a kill fluid, e.g., heavy weight fluid, through the subsea tree 120 to increase the hydrostatic pressure within the wellbore 112 and prevent the uncontrolled ingress of fluid from one or more formations into the wellbore 112. A heavy weight fluid may be pump down to the tree 120 or on top of the tree 120. A pumping operation can apply pressure within the riser 106 and/or tubing string 114 and within the subsea tree 120 with the ball 220 in the closed position, e.g., third position of FIG. 2D. The applied pressure on the ball 220, e.g., from the first wellbore environment above the ball 220, can move the second piston 226 the axial distance "A" from the third position, e.g., sealing position, to the second position, e.g., shear position. For example, the applied pressure above the ball 220 can provide a force to overcome the pressure within the wellbore 112 below the ball 220 and the force exerted on the one or more push rods 208 by the seal piston, e.g., nitrogen pressure on each of the end faces 233 of the push rods 208. The applied pressure on the ball 220 can move the ball valve assembly 210 from the sealing position, e.g., third position, to the shear position, e.g., second position. In response to the ball 220 not in the sealing position, the pumping operation can pump fluid through the passage 264 of the ball 220 from the first wellbore environment above the ball valve 210 to a second wellbore environment below the ball valve 210.

In some embodiments, the pumping operation can end when the wellbore pressure above the ball valve 210 is equalized or nearly equivalent to the wellbore pressure below the ball valve 210, e.g., within the wellbore 112. In some embodiments, the tree 120 can be retrieved from the BOP stack 108 for further wellbore service operations.

Although the subsea tree 200 is illustrated with valve assembly 210, e.g., a single ball 220, it is understood that the subsea tree 200 could include 2, 3, 4, or any number of valve assemblies 210. For example, the subsea tree 200 could comprise an upper valve assembly and lower valve assembly as illustrated with subsea tree 108 in FIG. 1.

Figure 3A:
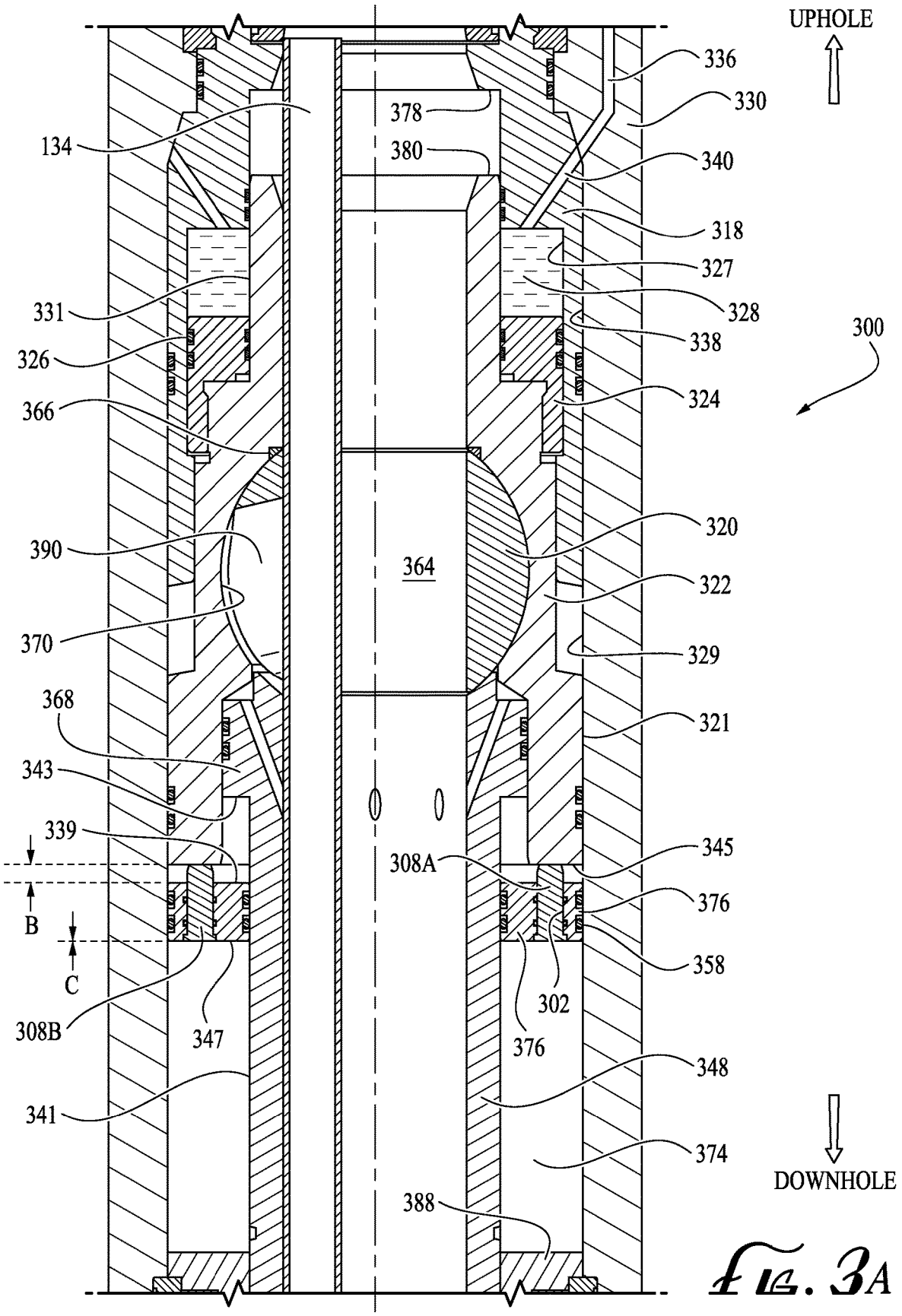
FIG. 3A is a partial cross-sectional view of a subsea tree assembly in an open position with a workstring positioned within a valve according to another embodiment of the disclosure.

Turning now to FIG. 3A, a partial cross-sectional view of a subsea test tree can be described. In some embodiments, the subsea test tree 300 can be an embodiment of subsea test tree 120 of FIG. 1. The subsea test tree 300 comprises a ball 320 rotationally coupled to a ball support 322, a control piston 324, an activation piston 376, and one or more push rods 308. Similar to subsea tree 200, subsea test tree 300 can be configured into an open position, a shear position, and a closed position. For example, pressure applied to the control piston 324 can actuate the ball 320 to a first position, e.g., open position. The ball 320 can be rotated to the shear position by an activation of a valve actuator, e.g., release of pressure from a control chamber 328. For example, the applied pressure to the control piston 324 can be released and/or removed, e.g., a conduit sheared by a ram, and a valve actuator comprising an activation chamber 374 filled with a predetermined pressure of gas, e.g., nitrogen, can bias the activation piston 376 and the one or more push rods 308 to actuate the ball 320 to a second position, e.g., shear position. In this scenario, a large cross-sectional area of the activation piston 376 with the one or more push rod 308 and the pressure within the activation chamber 374 can provide a rotational force to the ball 320 to shear or break a workstring, e.g., workstring 134, within the ball passage 364. The ball 320 can be rotated from the shear position to the closed position by a smaller amount of force compared to the force generated to shear the workstring 134. In a second scenario, a small cross-sectional area of the one or more push rods 308 and the pressure within the activation chamber 374 can provide a rotational force to rotate the ball 320 into a third position, e.g., a sealed position. In some embodiments, the small cross-sectional area can be a percentage of the large cross-sectional area, for example, 5%, 10%, 15%, 20%, or 25%, or any fraction between 5% to 25% of the large cross-sectional area. In some embodiments, the force generated to rotate the ball 320 from the shear position to the closed position can be an order of magnitude less than the force generated to rotate the ball 320 from the open position to the shear position.

In some embodiments, the ball support 322 can be generally cylinder in shape with an outer surface 321 and a spherical inner surface 370. A control piston 324 generally cylinder in shape can be coupled to the ball support 322. The one or more seals 326 of the control piston 324 can be sealingly engaged with an inner surface 327 of a control cylinder 318. A control chamber 328 can be formed by the inner surface 327 of the control cylinder 318, the control piston324, an outer surface 331 of the ball support 322, and an end face of the control cylinder 318. The control chamber 328 can be fluidically coupled to a conduit 336 by a fluid port 340 and may be filled with hydraulic fluid or any similar fluid. Fluid pressure applied to the control chamber 328 via the conduit 336 can axially translate the control piston 324 and ball support 322 relative to the control cylinder 318. A rotational translation of the ball 320 can be generated by the axial translation, e.g., linear movement parallel to the longitudinal axis of the subsea tree 300, of the ball support 322 to the control cylinder 318 via one or more control arms coupled to the ball 220.

In some embodiments, an activation chamber 374 can be filled with a predetermined volume and/or pressure of gas, e.g., nitrogen. The activation chamber 374 can be formed by an outer surface 341 on an activation mandrel 348, an end surface of a cylinder plug 388, the inner surface 338 of a valve housing 330, and the cross-sectional area of the activation piston 376. The activation piston 376 can be generally cylinder shape with one or more seals 358 in sealing engagement with the inner surface 338 of the valve housing 330 and one or more seals in sealing engagement with the outer surface 341 of the activation mandrel 348. The one or more push rods 308 can be sealingly engaged with seals installed in corresponding rod ports 302.

The ball 320 in the subsea tree 300 can be configured in the open position by applying a predetermined pressure of hydraulic fluid to the control chamber 328 from the control station 124 via the conduit 336. The predetermined pressure within the control chamber 328 can axially translate the ball support 322 to rotationally translate the ball 320 to the open position by moving, e.g., axially translating, the activation piston 376 against the nitrogen charge, e.g., pressure within the activation chamber 374. A back face 345 of the ball support 322 can contact the front face 339 of the activation piston 376 and axially translate the activation piston 376 a linear distance "B" from a back face 343 of a boss 368 on the activation mandrel 348. The ball 320 can remain in the open position in response to the predetermined pressure of hydraulic fluid within the control chamber 328 preventing the movement of the activation piston 376.

In some embodiments, a wellbore servicing operation can convey a tool string and/or workstring 134 through the ball passage 364. For example, a service tool string, e.g., a positioning tool, can be conveyed on coil tubing through the ball passage 364 to operate, e.g., open and/or close, a completion valve.

Figure 3B:
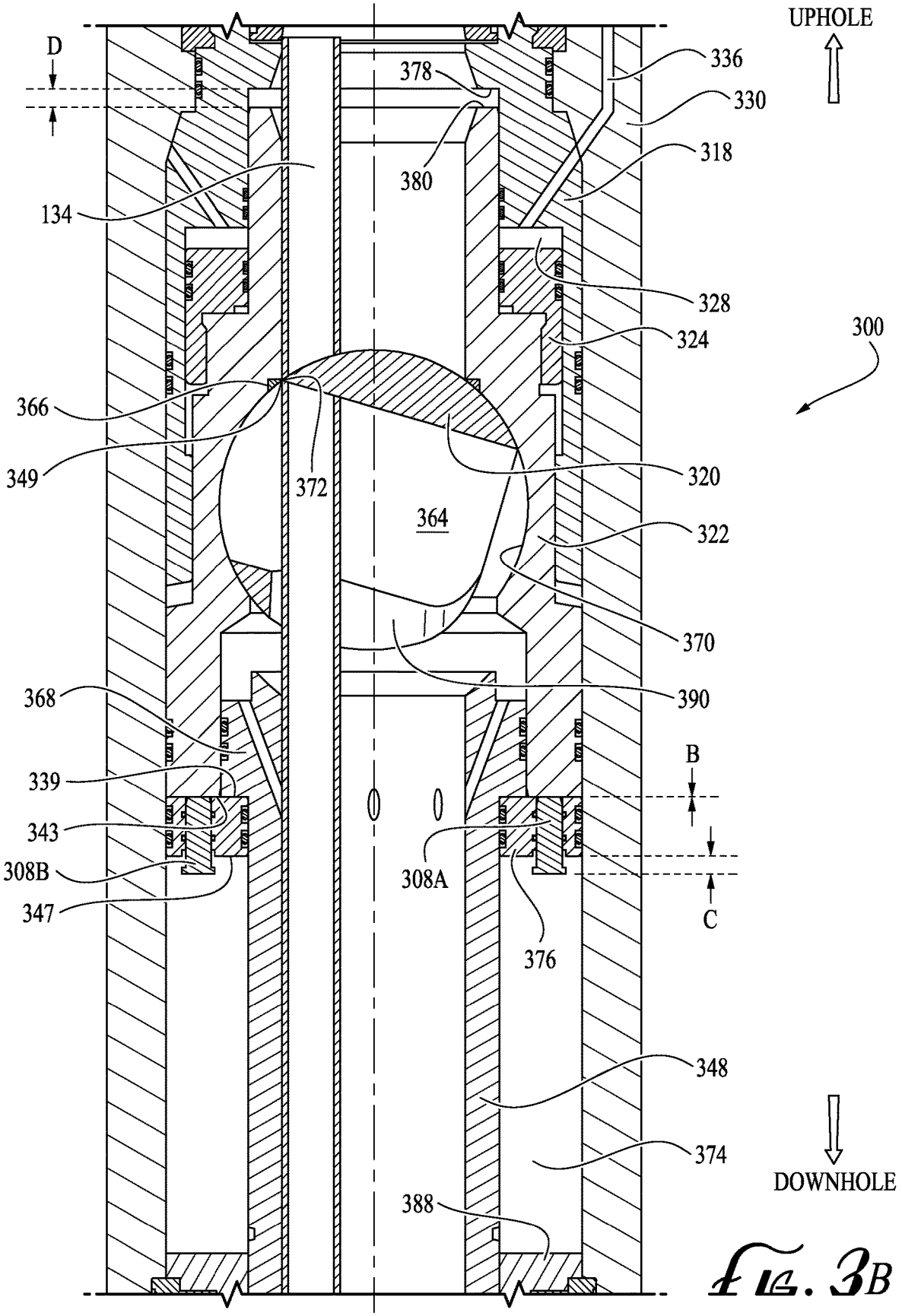
FIG. 3B is a partial cross-sectional view of a subsea tree assembly in a shear position with a workstring positioned within a valve according to another embodiment of the disclosure.

The subsea tree 300 can be actuated to the closed position by reducing or removing the applied pressure to the control chamber 328. Turning now to FIG. 3B, a partial cross-sectional view of the subsea tree 300 in a second position can be described. In some embodiments, the reduction of fluid pressure within the control chamber 328 can rotationally translate the ball 320 from a first position, e.g., an open position, to a second position, e.g., a shear position. The nitrogen charge, e.g., nitrogen pressure within activation chamber 374, can bias the activation piston 376 to axially translate the activation piston 376 until the distance "B" is zero, e.g., until the front face 339 of the activation piston 376 contacts the limit shoulder 343 of a boss 368 on the activation mandrel 348. In some embodiments, the one or more push rods 308A-B can extend out a back face 347 of the activation piston 376 an axial distance "C" in response to contacting the limit shoulder 343 of the support 322 as the activation piston 376 continues to translate to contact the limit shoulder 343. The nitrogen charge can bias both the activation piston 376 and the one or more push rods 308 towards the support 322. The axial translation of the ball support 322 the distance "B" can rotationally translate the ball 320 to cut or shear through the workstring 134, e.g., ball edge 372 of the passage 364 of the ball 320 can be i) aligned or ii) overlapped with a cutting edge 349 of the ball support 322 in the second position. In some embodiments, the workstring 134 can be located in a slot 390 in the ball 320 on the opposite side of the ball edge 372. In some scenarios, the portion of the workstring 134 sheared off by the second position can fall away, e.g., travel downwards within the wellbore 112 in the direction away from the seafloor 110. Although not all parts and surfaces of FIG. 3A are labeled in FIG. 3B, it is understood that the parts and surfaces of FIG. 3B are the same as FIG. 3A.

Figure 3C:
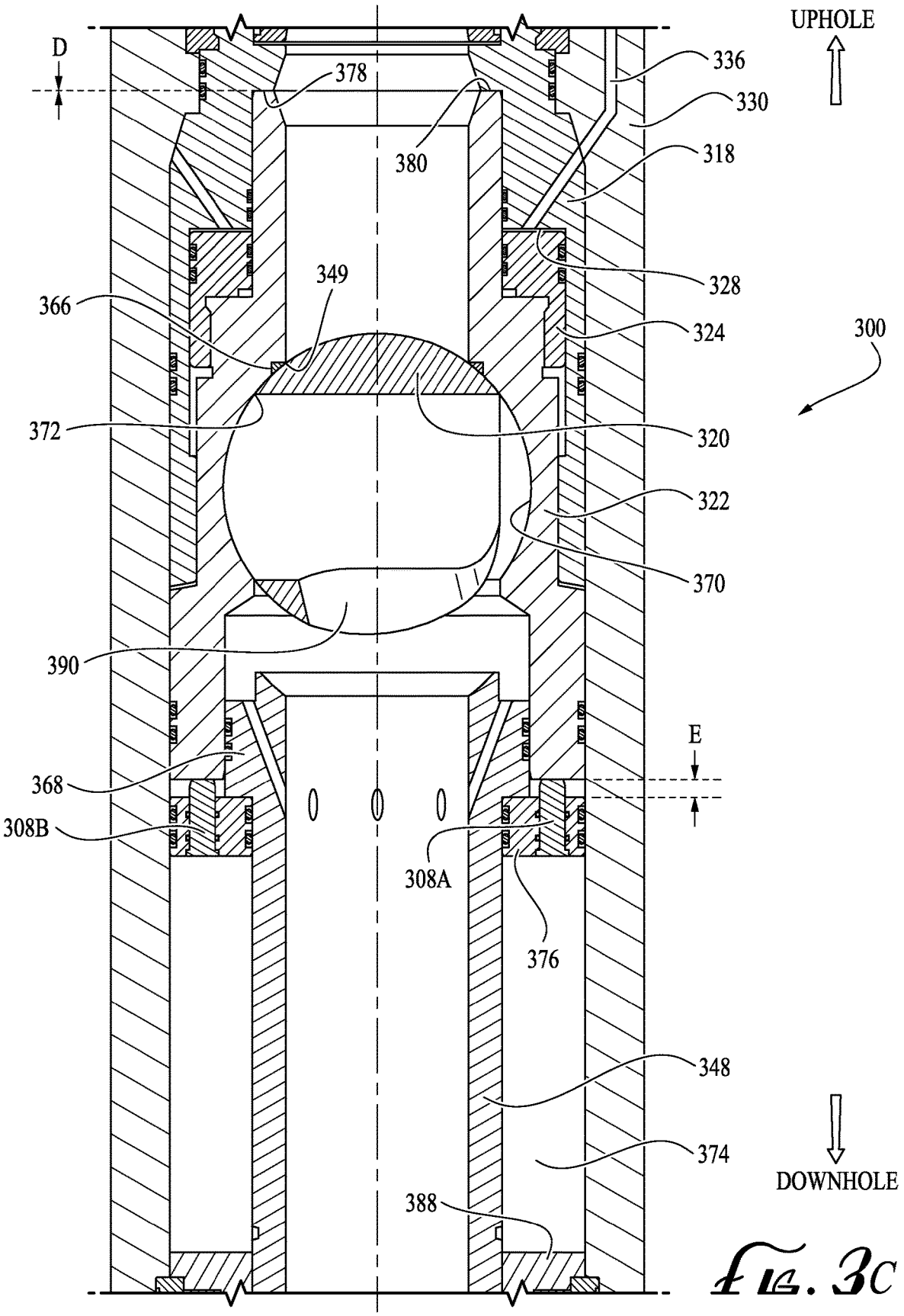
FIG. 3C is a partial cross-sectional view of a subsea tree assembly in a closed position according to another embodiment of the disclosure.
Figure 3D:
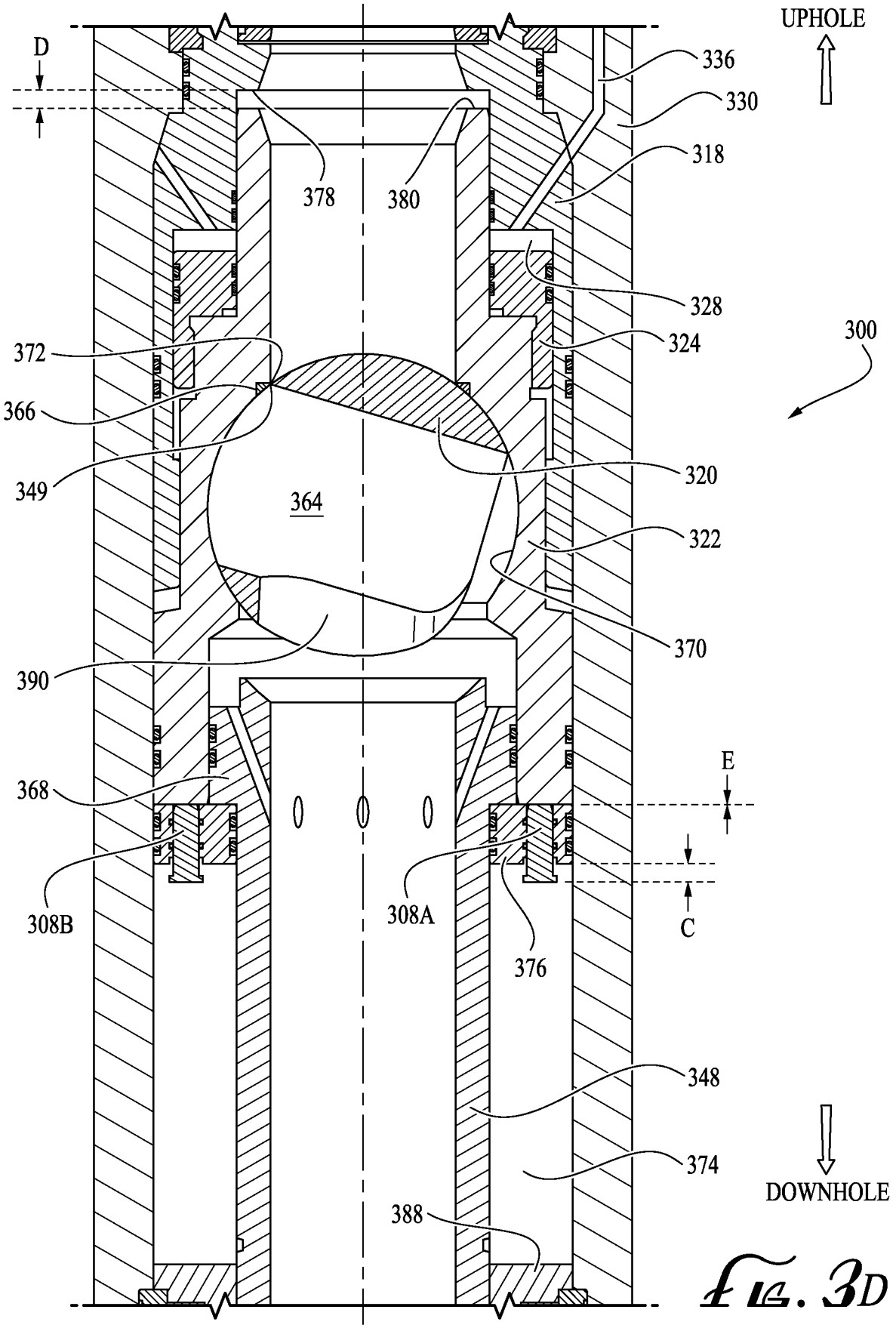
FIG. 3D is a partial cross-sectional view of a subsea tree assembly in a shear position according to another embodiment of the disclosure.

A smaller force can be utilized to close the ball 320 after the shearing action of the second position of the subsea tree 300. Turning now to FIG. 3C, a smaller force can be utilized to close the ball 320 or configure the ball in a third position. The support 322 can be moved to a third position from the second position by the one or more push rods 308A-B traveling an axial distance "E." Likewise, the ball 320 can be rotated from a second position, e.g., the shear position, to a third position, e.g., a closed position, by the support 322. The support 322 can be in sealing engagement with the ball 320 in response to the passage 364 of the ball 320 rotating past a ball seal 366 on the support 322. In other words, the ball 320 may hold pressure in the sealing position and prevent fluid from transferring from a first wellbore environment above the ball valve 310 to a second wellbore environment below the ball valve 310, or vise-versa. In a context, the force utilized to close the ball 320 can be a fraction of the force utilized in the shearing operation. For example, the cross-sectional area and/or the force to close the ball 320 can be can be 5%, 6%, 7%, 8%, 9%, 10%, 11%, 12%, 13%, 14%, 15% or any fraction from 5% to 15% of the cross-sectional area and/or force to position the ball 320 into the shear position.

A pumping operation can apply pressure within the riser 106 and/or tubing string 114 and within the subsea tree 300 with the ball 320 in the closed position, e.g., third position of FIG. 3C. The applied pressure on the ball 320, e.g., from the first wellbore environment above the ball 320, can move an upper face 380 of the ball support 322 an axial distance "D" to contact the lower face 378 of the control cylinder 318 and the one or more push rods 308 an axial distance "E" from the third position, e.g., sealing position, to the second position, e.g., shear position. For example, the applied pressure above the ball 320 can provide a force to overcome the wellbore pressure within the wellbore 112 below the ball 220 and the force exerted on the one or more push rods 308A-B by the nitrogen charge, e.g., nitrogen pressure on each of the end faces of the push rods 308. The applied pressure on the ball 320 can move the ball 320 from the sealing position, e.g., third position, to the shear position, e.g., second position. In response to the ball 320 not in the sealing position, the pumping operation can pump fluid through the passage 364 of the ball 320 from the first wellbore environment above the test tree 300 to a second wellbore environment below the test tree 300.

Although the subsea tree 300 is illustrated with a single ball, e.g., ball 320, it is understood that the subsea tree 300 could include 2, 3, 4, or any number of balls 320A-D. For example, the subsea tree 300 could comprise an upper valve assembly and lower valve assembly as illustrated with subsea tree 108 in FIG. 1.

Although subsea tree 120, 200, 300 is disclosed as located within the BOP stack 108, it is understood that the method and apparatus for closing a valve, e.g., ball 220, 320, could be applied below the BOP stack 108. For example, the subsea tree 200, 300 could be located within an upper completion and/or lower completion as a completion valve configured to isolate the wellbore environment above the closed valve assembly from the wellbore environment below the closed valve assembly.

Disclosed herein is a method and apparatus for closing a valve on a subsea tree by applying a first value of force configured to shear or break a workstring positioned within the valve and subsequently applying a second value of force configured to position the valve in a closed position, e.g., sealing position. In some embodiments, the first value of force can be greater than the second value of force. A activation chamber 274, 374 can be filled with a predetermined volume of gas, e.g., nitrogen, to bias an activation piston 276, 376 towards a ball support 222, 322. The cross-sectional area of the activation piston 276, 376 includes one or more push rods 208, 308. The activation piston 276, 376 can axially translate towards the ball support 222, 322 in response to a transfer of fluid, e.g., hydraulic fluid, from a first chamber 280 and/or a control chamber 328. The axially translation of the ball support 222, 322 can rotationally translate the ball 220, 320 via one or more control arms. The ball 220, 320 can rotate from an open position until the ball edge 272, 372 contacts a workstring 134 within the ball passage 264, 364. The biasing force generated by the nitrogen charge on the activation piston 276, 376 can generate a cutting force or shear force, e.g., the first value of force, to cut through the workstring 134 with the ball edge 272, 372. The activation piston 276, 376 can contact and stop against a limit shoulder 262, 343 in response to reaching a second position, e.g., a shear position. The ball 220, 320 can be positioned in the second position, e.g., shear position, in response to the activation piston 276, 376 contacting the limit shoulder 262, 343. In some embodiments, the nitrogen charge acting on the cross-sectional area of the push rods 208, 308 can bias the ball support 222, 322 to axially translate in a direction opposite of or away from the activation chamber 274, 374. The axial translation of the ball support 222, 322 can rotationally translate the ball 220, 320 from a second position, e.g., shear position, to a third position, e.g., closed position. The biasing force generated by the nitrogen charge on the one or more push rods 208, 308 can generate a closing force, e.g., the second value of force, to engage a ball seal 266, 366 with the outer surface of the ball 220, 320. The second value of force to engage the ball seal 266, 366 can be less than the first value of force to shear the workstring 134.

Disclosed herein is a method and apparatus for pumping fluids through a closed valve on a subsea tree by unsealing the valve in response to applying a predetermined tubing pressure to the closed valve. In some embodiments, the ball 220, 320 on the subsea tree 200, 300 may be positioned in a closed position by the nitrogen charge, e.g., pressure within the activation chamber 274, 374. A pumping operation may apply a predetermined tubing pressure to a first wellbore environment above the closed valve, e.g., ball 220, 320 in the closed position. The predetermined tubing pressure applied to the cross-sectional area of the closed valve assembly may generate a biasing force to overcome the combined force of the fluid pressure within the second wellbore environment below the closed valve, e.g., within the wellbore 112, and the second value of force, e.g., the closing force generated by the one or more push rods 208, 308. The ball support 222, 322 can axially translate towards the activation chamber 274, 374 as the push rods 208, 308 travel the linear distance "E" into the activation piston 276, 376 and the ball 320 rotates from a sealing position to a shear position. In response to the ball 220, 320 not in the sealing position, the pumping operation can pump fluid through the passage 264, 364 of the ball 220, 320 from the first wellbore environment above the test tree 200, 300 to a second wellbore environment below the test tree 200, 300.

Additional Disclosure

The following are non-limiting, specific embodiments in accordance and with the present disclosure:

A first embodiment, which is a valve assembly for controlling fluid communication along a wellbore tubular, comprising: a ball with a fluid passage rotationally coupled to a ball support, wherein the ball can be configured in i) an open position, ii) a shear position, or iii) a closed position in response to axial movement of the ball support; a main piston sealingly coupled to an activation chamber with a gas charge within an activation chamber, a control piston sealingly coupled to a control chamber configured to axially translate the ball support into the open position in response to a predetermined volume of fluid delivered through a conduit; one or more push rods sealingly coupled to a corresponding rod port within the main piston, wherein the one or more push rods are configured to bias the ball support into a closed position by the gas charge; and one or more ball seals configured to sealingly engage an outer surface of the ball, wherein the one or more ball seals isolate a first wellbore environment above the ball from a second wellbore environment below the ball in response to the ball being configured in the closed position.

A second embodiment, which is the valve assembly of the first embodiment, wherein the ball is configured in ii) the shear position in response to a pumping operation applying a pumping pressure to the first wellbore environment above the ball, wherein the pumping pressure is greater than a wellbore pressure below the ball, wherein the ball support linearly translates to contact the main piston and the one or more push rods are axially translated into the activation chamber in response to the pumping pressure within the first wellbore environment above the ball; and wherein a flowrate of wellbore fluid can pass through the valve assembly in response to the pumping operation configuring the ball in ii) the shear position.

A third embodiment, which is the valve assembly of any of the first and the second embodiments, wherein the ball is configured in i) the open position in response to the ball support axially transitioning to the open position, wherein the ball support is in the open position in response to a fluid pressure within the control chamber overcoming the bias of the gas charge within the activation chamber, wherein the main piston axially translates into the activation chamber in response to the axial transition of the ball support to the open position, and wherein the volume within the activation chamber is decreased and the pressure of a compressible gas in increased in response to the axial translation of the main piston into the activation chamber; and wherein the fluid passage of the ball aligns with a tool passage within the valve assembly in the open position.

A fourth embodiment, which is the valve assembly of any of the first through the third embodiments, wherein the ball is configured in ii) the shear position in response to the ball support axially translating to the shear position, wherein the ball support is positioned in the shear position in response to the main piston contacting a limit shoulder, and wherein the main piston is in contact with the limit shoulder in response to a reduction in fluid volume within the control chamber.

A fifth embodiment, which is the valve assembly of the first through the fourth embodiments, wherein a passage edge of the ball is aligned with or overlaps a shear edge of the ball support in ii) the shear position; and wherein the passage edge of the ball is configured to cut through a workstring positioned within the ball passage in ii) the shear position.

A sixth embodiment, which is the valve assembly of any of the first through the fifth embodiments, wherein the ball is configured in iii) the closed position in response to the ball support axially translating to the closed position, wherein the ball support is positioned in the closed position in response to the one or more push rods extending from the main piston, wherein the one or more push rods are bias by the gas charge.

A seventh embodiment, which is the valve assembly of any of the first through the sixth embodiment, wherein the gas charge is a volume and pressure of compressible gas within the activation chamber, wherein the main piston is configured to bias the ball support to axially translate into the shear position by the gas charge.

A eighth embodiment, which is the valve assembly of any of the first through the seventh embodiments, wherein the one or more ball seals are located in a corresponding circumferential groove along a spherical surface within the ball support, and wherein the ball passage is perpendicular to the fluid passage through the valve assembly.

A ninth embodiment, which is the valve assembly of any of the first through the eighth embodiments, wherein a first cross-sectional area of the one or more push rods is less than a second cross-sectional area of the activation piston assembly.

A tenth embodiment, which is a method of operating a valve assembly within a wellbore, comprising activating a fail-safe actuator comprising a main piston and a gas charge within an activation chamber, and wherein a main piston sealingly coupled to the activation chamber transmits a biasing force generated by the gas charge; rotationally translating a valve to contact a workstring within a fluid passage of the valve assembly by axially translating a ball support from an open position by the fail-safe actuator, wherein the main piston is in contact with the ball support; and wherein the valve is configured to rotate in response to axial movement of the ball support; shearing the workstring with the valve in response to the biasing force of the fail-safe actuator; rotationally translating the valve into the shear position in response to the shearing of the workstring into two portions; rotationally translating the valve from the shear position to a closed position by axially translating the ball support with one or more push rods sealingly engaged with the main piston and fluidically coupled to the gas charge, wherein the one or more push rods are bias by the gas charge; and isolating a first wellbore environment above the valve in the closed position from a second wellbore environment below the valve.

An eleventh embodiment, which is the method of the tenth embodiments, further comprising pumping a wellbore fluid, by a pumping operation, through the valve in the shear position in response to axially translating the ball support to the shear position.

A twelfth embodiment, which is the method of any of the tenth through the eleventh embodiments, wherein the pumping operation increases a wellbore pressure in the first wellbore environment to bias the ball and ball support to overcome the gas charge and return the one or more push rods to the shear position.

A thirteenth embodiment, which is the method of any of the tenth through the twelfth embodiments, further comprising conveying a workstring into the wellbore below the valve assembly configured in the open position, wherein the workstring is positioned within a fluid passage of the valve assembly.

A fourteenth embodiment, which is the method of the tenth through the thirteenth embodiment, wherein the wellhead is located i) on land, ii) on a platform, iii) on a seafloor, iv) in water depth of under 10,000 feet, v) in water depth of over 10,000 feet, vi) or any combination thereof.

A fifteenth embodiment, which is the method of any of the tenth through the fourteenth embodiment, wherein the fail-safe actuator is activated by a loss of fluid pressure within a control chamber, and wherein the main piston of the fail-safe actuator is configured to axially translate by the gas charge.

A sixteenth embodiment, which is the method of any of the tenth through the fifteenth embodiment, wherein the main piston contacts a limit shoulder in the shear position.

A seventeenth embodiment, which method of operating a valve assembly within a wellbore, comprising: opening a valve assembly by transferring a first volume of fluid into a first chamber via a first fluid conduit; compressing a valve actuator with a second volume of fluid in a second chamber, wherein the valve actuator comprises a main piston sealingly coupled to an activation chamber with a gas charge; transferring the first volume and the second volume of fluid from the first chamber and the second chamber; closing the valve assembly from the open position to a shear position via the main piston of the valve actuator in response to the transfer of fluid from the first chamber; closing the valve assembly from the shear position to a closed position with one or more push rods; wherein the one or more push rods are sealingly coupled to the main piston; wherein the one or more push rods are fluidically coupled to and biased by the gas charge; and wherein the biasing force of the one or more push rods is less than the biasing force of the main piston.

A eighteenth embodiment, which is the method of the seventeenth embodiment, further comprising opening a valve assembly from the closed position to the shear position in response to a fluid pressure applied by a pumping operation to a wellbore environment above the valve assembly in the closed position; and pumping a wellbore fluid, by the pumping operation, through the valve assembly in the shear position in response to moving the valve from sealing engagement with a valve seal.

A nineteenth embodiment, which is the method of any of the seventeenth through the eighteenth embodiment, further comprising closing the valve assembly by transferring a third volume of fluid into a third chamber via a third fluid conduit as the first volume of fluid transfers out of the first chamber.

A twentieth embodiment, which is the method of any of the seventeenth through the nineteenth embodiment, further comprising shearing a workstring positioned within an axial bore of the valve assembly, and wherein the main piston bias the valve to shear through the workstring.

A twenty-first embodiment, which is the method of any of the seventeenth through the twentieth embodiment, wherein the first volume and second volume of fluid is transferred in response to shearing the first and second conduits.

A twenty-second embodiment, which is the method of any of the seventeenth through the twenty-first embodiment, wherein the second volume of fluid within the second chamber is the first volume of fluid within the first chamber.

A twenty-third embodiment, which is a method comprising placing the valve assembly of any of claims 1-9 within a blowout preventer stack coupled to a wellhead of a well.

A twenty-fourth embodiment, which is the method of any of the twenty-third embodiment, wherein the wellhead is located i) on land, ii) on a platform, iii) on a seafloor, iv) in water depth of under 10,000 feet, v) in water depth of over 10,000 feet, vi) or any combination thereof.

A twenty-fifth embodiment, which is the method of any of the twenty-third through the twenty-fourth embodiments, further comprising placing a workstring through the valve assembly and into the well.

A twenty-sixth embodiment, which is the method of any of the twenty-third through the twenty-fifth embodiments, further comprising performing a service selected from i) a cleaning operation, ii) a wellbore stimulation operation, iii) wellbore perforation operation, iv) a valve actuation, or v) combinations thereof via the workstring.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru-Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A valve assembly for controlling fluid communication along a wellbore tubular, the valve assembly comprising:

a ball having a fluid passage and rotationally coupled to a ball support, wherein the ball is configured to be in an open position, a shear position, or a closed position;

a main piston sealingly coupled to an activation chamber configured to contain a gas charge;

a control piston sealingly coupled to a control chamber and configured to axially translate the ball support to move the ball to the open position, in response to a volume of fluid being delivered through a conduit;

one or more push rods sealingly coupled to a corresponding rod port within the main piston, wherein the one or more push rods are configured to bias the ball support to move the ball to the closed position via the gas charge; and one or more ball seals configured to sealingly engage an outer surface of the ball, and isolate a first wellbore environment above the ball from a second wellbore environment below the ball when the ball is in the closed position, wherein the ball support is configured to linearly translate to contact the main piston.

2. The valve assembly of claim 1, wherein the ball is further configured to be in the shear position in response to a pumping operation applying a pumping pressure to the first wellbore environment above the ball, the pumping pressure is greater than a wellbore pressure below the ball, the ball support is further configured to linearly translate to contact the main piston, in response to the pumping pressure within the first wellbore environment above the ball, the one or more push rods are further configured to axially translate into the activation chamber, in response to the pumping pressure within the first wellbore environment above the ball, and a flow of wellbore fluid is enabled to pass through the valve assembly in response to the pumping operation moving the ball to the shear position.

3. The valve assembly of claim 1, wherein the ball is further configured to move to the open position by the ball support axially translating and in response to a fluid pressure within the control chamber overcoming a bias of the gas charge within the activation chamber, the main piston is configured to axially translate into the activation chamber in response to the axial transition of the ball support, a volume within the activation chamber is decreased and a pressure of a compressible gas in the activation chamber is increased in response to the axial translation of the main piston into the activation chamber, and the fluid passage of the ball aligns with a tool passage within the valve assembly when the ball is in the open position.

4. The valve assembly of claim 3, wherein the ball is further configured to move to the shear position in response to the ball support axially translating, and the main piston is configured to contact a limit shoulder when the ball is in the shear position and in response to a reduction in fluid volume within the control chamber.

5. The valve assembly of claim 1, wherein a passage edge of the ball is configured to be aligned with or overlap a shear edge of the ball support and cut through a workstring positioned within the ball passage when the ball is in the shear position.

6. The valve assembly of claim 5, wherein the ball is further configured to move to the closed position, in response to the ball support axially translating and in response to the one or more push rods extending from the main piston, and the one or more push rods are biased by the gas charge.

7. The valve assembly of claim 6, wherein the one or more ball seals are located in a corresponding circumferential groove along a spherical surface within the ball support, and the ball passage is perpendicular to the fluid passage.

8. The valve assembly of claim 1, wherein the gas charge comprises a volume of compressible gas within the activation chamber, and the main piston is configured to bias the ball support to axially translate via the gas charge.

9. The valve assembly of claim 1, wherein a cross-sectional area of the one or more push rods is less than a cross-sectional area of the main piston.

10. A method of operating a valve assembly within a wellbore, comprising:

activating a fail-safe actuator comprising a main piston and an activation chamber containing a gas charge, wherein the main piston is sealingly coupled to the activation chamber and transmits a biasing force generated by the gas charge;

rotationally translating a valve to contact a workstring having a fluid passage by axially translating a ball support by the fail-safe actuator, wherein the valve rotates from an open position in response to the axial translating of the ball support;

shearing the workstring by the valve in response to the biasing force, wherein the valve rotationally translates into a shear position to shear the workstring into two portions, and wherein the main piston contacts the ball support and a limit shoulder when the valve is in the shear position; and rotationally translating the valve from the shear position to a closed position by axially translating the ball support by one or more push rods sealingly engaged with the main piston, wherein the one or more push rods are biased by the gas charge, and wherein a first wellbore environment above the valve is isolated from a second wellbore environment below the valve when the valve is in the closed position.

11. The method of claim 10, further comprising:

pumping a wellbore fluid, by a pumping operation, through the valve in the shear position in response to axially translating the ball support.

12. The method of claim 11, wherein the pumping operation increases a wellbore pressure in the first wellbore environment to bias the ball and the ball support to overcome the gas charge and move the one or more push rods.

13. The method of claim 10, further comprising:

placing the valve assembly within a blowout preventer stack coupled to a wellhead which is coupled to the wellbore;

conveying the workstring into the wellbore below the valve assembly which is in the open position, wherein the workstring is positioned within the fluid passage; and performing a cleaning operation, a wellbore stimulation operation, a wellbore perforation operation, a valve actuation, or combinations thereof, via the workstring.

14. The method of claim 13, wherein the wellhead is located on land, on a platform, on a seafloor, in water at a depth of under 10,000 feet, in water at a depth of over 10,000 feet, or any combination thereof.

15. The method of claim 10, wherein the fail-safe actuator is activated in response to a loss of fluid pressure within a control chamber, and wherein the main piston axially translates by the gas charge.

16. A method of operating a valve assembly within a wellbore, comprising:

opening a valve assembly by transferring a first volume of fluid into a first chamber via a first fluid conduit;

compressing a valve actuator with a second volume of fluid in a second chamber, wherein the valve actuator comprises a main piston sealingly coupled to an activation chamber containing a gas charge;

transferring the first volume of fluid and the second volume of fluid from the first chamber and the second chamber;

closing the valve assembly from an open position to a shear position via the main piston by transferring a third volume of fluid into a third chamber via a third fluid conduit as the first volume of fluid transfers out of the first chamber; and closing the valve assembly from the shear position to a closed position by one or more push rods, wherein the one or more push rods are sealingly coupled to the main piston, and wherein a biasing force exerted by the gas charge on the one or more push rods is less than a biasing force exerted by the gas charge on the main piston.

17. The method of claim 16, further comprising:

opening the valve assembly from the closed position to the shear position in response to a fluid pressure applied by a pumping operation to a wellbore environment above the valve assembly; and pumping a wellbore fluid, by the pumping operation, through the valve assembly in the shear position, in response to moving a valve of the valve assembly from sealing engagement with a valve seal.

18. The method of claim 16, further comprising:

shearing a workstring positioned within an axial bore of the valve assembly, wherein the main piston biases a valve of the valve assembly to shear through the workstring.

19. The method of claim 16, wherein the first volume of fluid and the second volume of fluid are transferred in response to shearing the first and second conduits.

20. The method of claim 16, wherein the second volume of fluid within the second chamber is the first volume of fluid within the first chamber.

21. A valve assembly for controlling fluid communication along a wellbore tubular, the valve assembly comprising:

a ball having a fluid passage and rotationally coupled to a ball support, wherein the ball is configured to be in an open position, a shear position, or a closed position;

a main piston sealingly coupled to an activation chamber configured to contain a gas charge;

a control piston sealingly coupled to a control chamber and configured to axially translate the ball support to move the ball to the open position, in response to a volume of fluid being delivered through a conduit;

one or more push rods sealingly coupled to a corresponding rod port within the main piston, wherein the one or more push rods are configured to bias the ball support to move the ball to the closed position via the gas charge; and one or more ball seals configured to sealingly engage an outer surface of the ball, and isolate a first wellbore environment above the ball from a second wellbore environment below the ball when the ball is in the closed position, wherein the ball support is configured to linearly translate to contact the main piston, wherein the ball is further configured to move to the open position by the ball support axially translating and in response to a fluid pressure within the control chamber overcoming a bias of the gas charge within the activation chamber, wherein the main piston is configured to axially translate into the activation chamber in response to the axial transition of the ball support, wherein a volume within the activation chamber is decreased and a pressure of a compressible gas in the activation chamber is increased in response to the axial translation of the main piston into the activation chamber, wherein the fluid passage of the ball aligns with a tool passage within the valve assembly when the ball is in the open position, wherein the ball is further configured to move to the shear position in response to the ball support axially translating, and wherein the main piston is configured to contact a limit shoulder when the ball is in the shear position and in response to a reduction in fluid volume within the control chamber.

* * * * *